United States Patent [19]

Goetz

[11] Patent Number: 4,656,894

[45] Date of Patent: Apr. 14, 1987

[54] RATCHET WRENCH

[76] Inventor: Harold E. Goetz, 1004 First, Dodge City, Kans. 67801

[21] Appl. No.: 848,798

[22] Filed: Apr. 7, 1986

[51] Int. Cl.[4] ..... B25B 13/00

[52] U.S. Cl. ..... 81/57.43; 81/58.1

[58] Field of Search ..... 81/57–57.43, 81/177.1, 177.7, 60–63.2, 58.1

[56] References Cited

U.S. PATENT DOCUMENTS 2,292,391 8/1942 Merriman ..... 81/57.43

3,019,681 2/1962 Grissom ..... 81/61

*Primary Examiner*—Frederick R. Schmidt

*Assistant Examiner*—Maurina Rachuba

*Attorney, Agent, or Firm*—Harvey B. Jacobson

[57] ABSTRACT

A ratchet wrench has a chain drive and three separate operating handles enabling the wrench to be operated in three different modes providing various degrees of torque and various speed ratios.

10 Claims, 9 Drawing Figures

FIG. 1
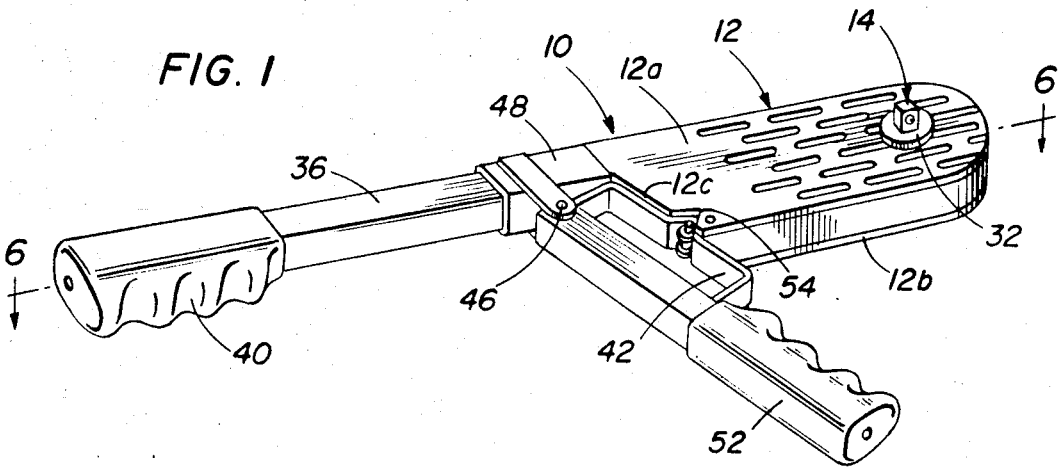
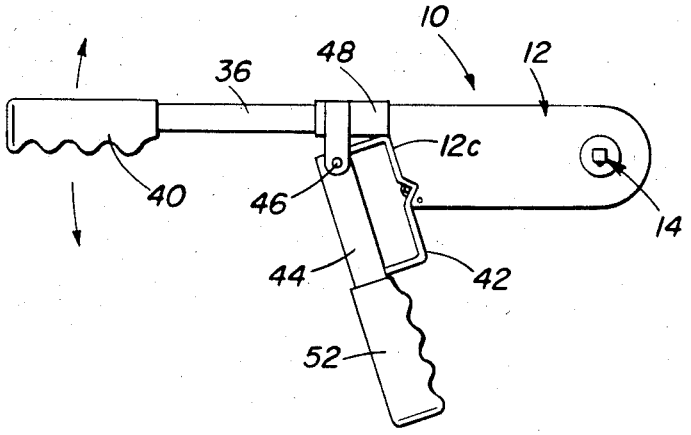
FIG. 2
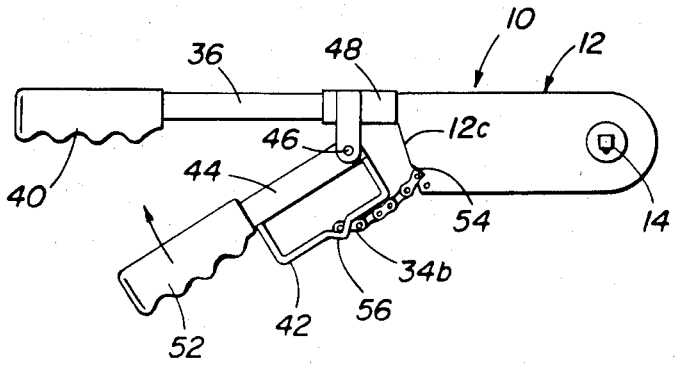
FIG. 3
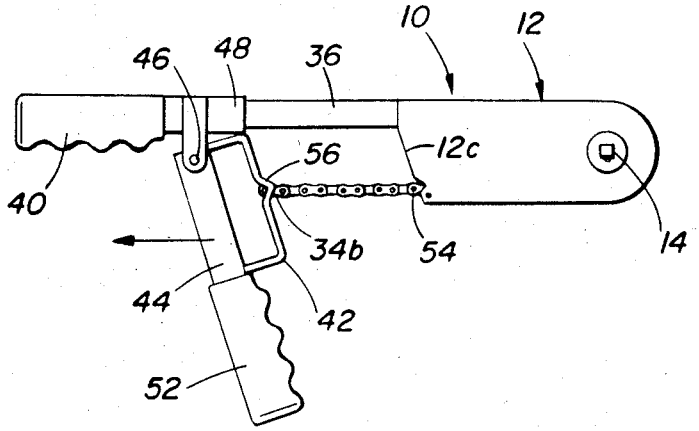
FIG. 4

RATCHET WRENCH

BACKGROUND OF THE INVENTION

This invention relates to a ratchet wrench. Simple forms of ratchet wrench may, for example, comprise a wrench head and handle with a workpiece gripping element rotatably mounted in the head and a ratchet mechanism connected between the head and the gripping element so that the ratchet mechanism provides a drive connection between the handle and the gripping element in one direction of rotation of the handle, for applying torque to a workpiece and disconnects the drive connection in the opposite direction of rotation of the handle. In this simple form of ratchet wrench, torque is applied to the gripping element directly through the handle and there is limited scope for variation of the applied torque if, for example, rapid turning of a workpiece such as a screw or nut is required when little torque is required. Accordingly, more sophisticated ratchet wrenches are known incorporating different mechanisms for varying the torque applied to the driven member so as, for example, to provide more rapid operation if little torque is required.

Examples of earlier forms of ratchet wrench are shown in the following U.S. patents:

U.S. Pat. No. 2,288,217, June 30, 1942
U.S. Pat. No. 2,530,553, Nov. 21, 1950
U.S. Pat. No. 3,286,560, Nov. 22, 1966
U.S. Pat. No. 3,447,404, June 3, 1969
U.S. Pat. No. 3,572,188, Mar. 23, 1971
U.S. Pat. No. 3,941,017, Mar. 2, 1976
U.S. Pat. No. 4,224,844, Sept. 30, 1980
U.S. Pat. No. 4,507,989, Apr. 2, 1985.

SUMMARY OF THE INVENTION

It is an object of the present invention to provide a novel form of ratchet wrench which is of relatively simple and robust construction yet which provides a degree of versatility in its method of operation whereby different torque or speed ratios may be applied to a driven ratchet member to suit varying workpiece conditions.

A ratchet wrench in accordance with the invention comprises a wrench head, an elongate first wrench operating handle extending from one end of the head, a driving ratchet member rotatably mounted in the wrench head, a driven ratchet member rotatably mounted in the wrench head for engaging a workpiece to be turned, a pawl connected between the ratchet members for providing a drive connection therebetween in one direction of rotation of the driving member and for disconnecting the drive connection in the other direction of rotation of the driving member, a chain looped around the driving ratchet member for rotating same, the chain having opposite ends extending from said end of the wrench head, a spring connected between one end of the chain and the first wrench handle, a second handle attached to the other end of the chain, a slide connection between the first and second handles for allowing reciprocatory sliding movement of the second handle along the first handle effective to extend and retract the other end of the chain with respect to the wrench head thereby rotating the driving ratchet member, a pivot joint between the second handle and the slide connection, and an extension extending laterally from the second handle is provided with a handgrip for providing pivotal movement of the second handle when the slide connection is in engagement against said end of the wrench head, the pivotal movement also being effective to extend and retract the other end of the chain with respect to the wrench head so as to rotate the driving ratchet member.

The handles and handgrip on the extension of the wrench provide three different modes of operation. Thus, the first handle may be used in the manner of a conventional simple ratchet wrench with the second handle engaging against the wrench head to resist movement of the chain and apply torque. Alternatively, in a second mode of operation, the second handle can be used in reciprocatory fashion along the first handle to extend and retract the chain in a manner providing rapid operation of the ratchet mechanism with reduced operator torque, and further alternatively, the extension and handgrip on the second handle provides a third mode of operation by pivotal reciprocation while the slide connection is in engagement with the wrench head. The third mode of operation provides somewhat increased torque compared with the second mode but limited rotation with each stroke.

The wrench is of generally simple construction and provides good flexibility in its mode of operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is an outside perspective view of a ratchet wrench in accordance with the invention.

FIGS. 2–4 are somewhat diagrammatic views of the wrench illustrating its different modes of operation.

DESCRIPTION OF PREFERRED EMBODIMENT

Figures 5, 6, 7, 8, 9:
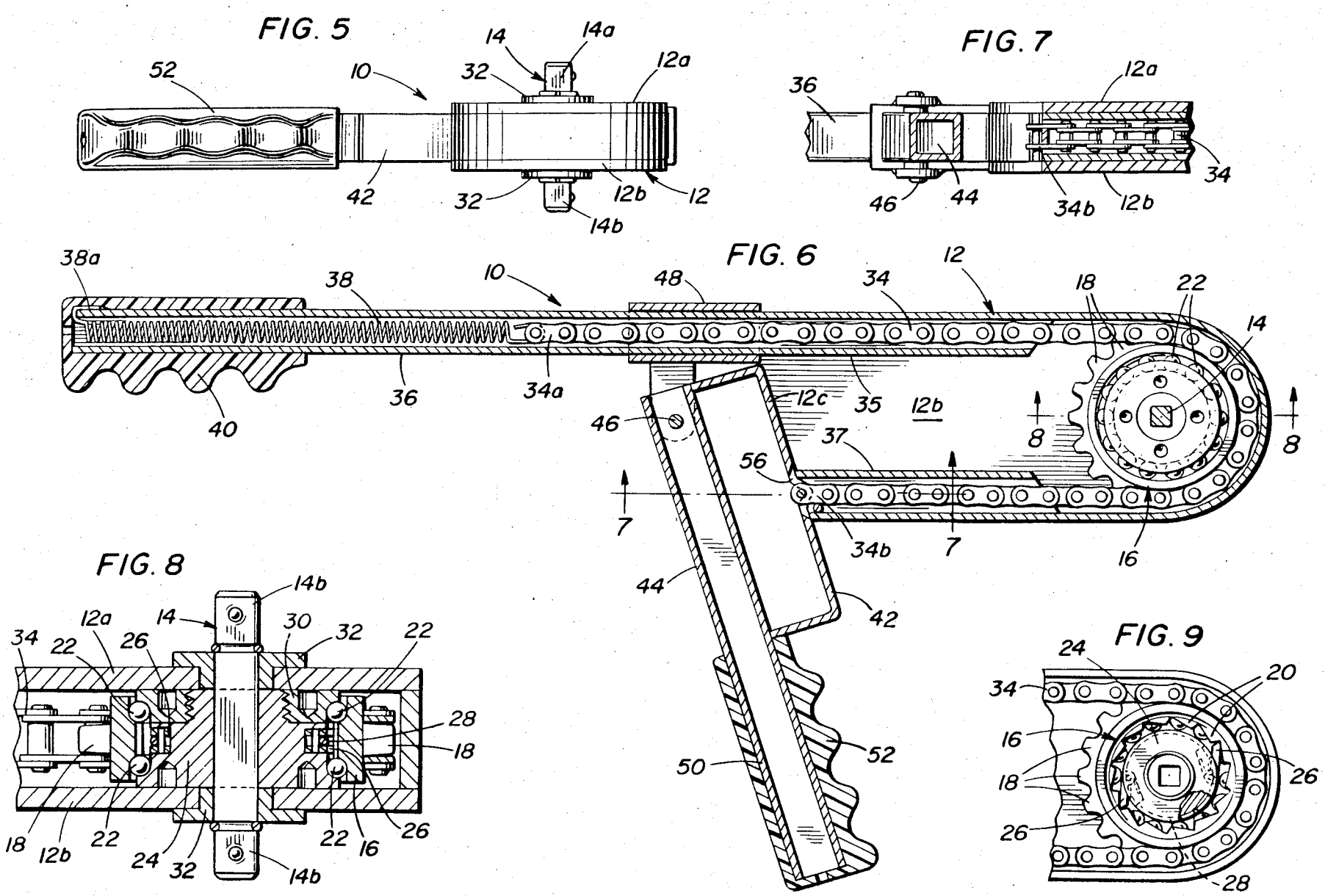
FIG. 5 is an end view of the wrench.
FIG. 6 is an enlarged sectional view on line 6—6 of FIG. 1.
FIG. 7 is an enlarged sectional view on line 7—7 of FIG. 6.
FIG. 8 is an enlarged sectional view on line 8—8 of FIG. 6.
FIG. 9 is a sectional view of the ratchet head.

A ratchet wrench in accordance with the invention is generally indicated by reference 10 in the drawings. The wrench has a wrench head 12 in which is rotatably mounted, a socket drive member 14 of conventional form with opposite ends **14*a* and 14*b* extending from opposite sides of the wrench, so that the wrench can be used selectively for forward and reverse rotation of a socket by turning the wrench over and using either end 14*a* or 14*b* of the drive member. A ratchet mechanism, as will be described, is contained within the wrench head for rotating drive member 14**.

In more detail, the ratchet mechanism, which is carried between opposite side plates **12*a* and 12*b* of the wrench head, (see particularly FIG. 8) comprises a rotary driving ratchet member 16 in the form of a sprocket wheel with external peripheral sprocket teeth 18 and internal ratchet teeth 20. The driving ratchet member 16 is journalled by balls 22 around the exterior of a driven ratchet member 24 which is formed with a rectangular central through bore for receiving the drive element 14. Opposed outwardly sprung pawls 26 may be mounted, for example, by means of a retention ring 28 in opposed recesses on the periphery of the driven ratchet member 24 to engage the ratchet teeth 20 of sprocket wheel 16 so that rotation of the sprocket wheel in one direction is effective for forming a drive connection through the pawls with driven members 24 and 14, while when the sprocket wheel 16 is rotated in the opposite direction, the pawls serve to disconnect it from driven members 14 and 24**.

It is to be understood that the particular form of ratchet mechanism herein described is not critical to the invention and different types of known ratchet mechanisms may be used in the wrench head 12. The driven ratchet member 24 has a screw-in end cap 30 (see FIG. 8) and it is located by bearings 32 in suitable openings through the respective side plates 12*a* and 12*b* of the wrench head.

A drive chain 34 is looped around the sprocket wheel 16 in mesh with the drive sprocket teeth 18, the chain being guided in suitable tracks 35, 37 (FIG. 6) formed adjacent the outer edges of the wrench head.

Extending from one end 12*c* of the wrench head is an elongate first wrench handle 36 of hollow tubular form. One end of chain 34 extends into handle 36 and is connected to an elongate coil spring 38 at one end of the spring, the the other end of the spring being trapped at 38*a* by the end of the handle. The handle may be provided with a conventional form of handgrip 40.

The other end 34*b* of chain 34 is connected to a yoke-like guard 42 extending from a second wrench operating handle 44. Handle 44 has a pivot connection 46 with a slide 48 which can slide along handle 36. An extension 50 of handle 44 extends laterally from handle 44 and may be provided with a second handgrip 52.

It will be noted that end surface 12*c* of the head 12 is inclined with respect to handle 36 in a direction toward the opposite end of the wrench head and the surface has a V-shaped notch 54 effectively forming the entrance to channel 37 and serving to accurately locate the chain by engagement therein of a complementary V-shaped projection 56 on bridge member 42.

The wrench has three different modes of operation. Thus, as indicated in FIG. 2, with slide 48 and bridgepiece 42 engaging against the end 12*c* of the wrench head, the wrench can be operated in conventional manner using handle 36 in a swinging motion. In this mode of operation, engagement of the bridgepiece 42 against the wrench head serves to resist movement of chain 34 when the wrench handle is swung in one direction so as transmit torque through the ratchet mechanism while allowing a ratcheting action in the opposite direction of swing of the handle.

For operation with reduced torque but somewhat quicker strokes, handle 44 can be grasped in one hand while grip 40 is held in the other hand and handle 44 can be reciprocated lengthwise by movement of slide 48 along handle 36 as indicated in FIG. 4. In this mode of operation, the chain serves to rotate sprocket wheel 16 in one direction, for the application of torque, when slide 48 moves away from head 12 against the action of spring 38, and to allow rotation of the sprocket wheel in the opposite direction disconnected from member 24 when it moves back toward head 12 under the influence of spring 38.

For the application of quick strokes with a torque that is somewhat increased compared with the torque applied in the mode of operation of FIG. 4, the wrench can be operated as indicated in FIG. 3. In this case, grasping handgrip 40 in one hand and handgrip 52 in the other hand, handle 44 and bridgepiece 42 may be pivotally reciprocated about pivot 46 while slide 48 engages end 12*c* of the head for resistance. It will again be evident that back and forth pivotal reciprocation of the handle effects forward and reverse movement of the chain as previously but the configuration of the extension 50 allows somewhat increased torque to be applied to element 14.

It will thus be seen that the wrench which is of generally simple structure can be operated in three different modes to provide three different torque ranges and speeds of application. It will also be evident that numerous modifications can be made within the scope of the invention compared with the specific embodiment herein described. Thus, for example, the driven ratchet member 24 could be designed as a box-type wrench rather than having a through bore for locating a socket head as shown. Other modification are also possible in the ratchet mechanism as indicated.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A ratchet wrench comprising a wrench head, an elongate first wrench operating handle extending rigidly from one end of the wrench head, a driving ratchet member rotatably mounted in the wrench head, a driven ratchet member rotatably mounted in the wrench head for engaging a workpiece to be turned, pawl means connected between the ratchet members for providing a drive connection therebetween in one direction of rotation of the driving member and for disconnecting said drive connection in the other direction of rotation of the driving member, an elongate flexible drive element looped around the driving ratchet member for rotating the driving ratchet member, the drive element having opposite ends extending from said one end of the wrench head, a longitudinally extendible resilient resistance member connected between one end of the drive element and the first handle, a second handle attached to the other end of the drive element, a guide means for providing reciprocatory sliding movement of the second handle from said one end of the wrench head in a direction substantially parallel to the first handle effective to extend and retract said other end of the drive element with respect to said end of the wrench head and thereby rotate the driving ratchet member, a pivot joint between the second handle and said guide means, and an extension extending laterally from the second handle for providing pivotal movement of the second handle when the guide means is in engagement against said one end of the wrench head and is also effective to extend and retract said other end of the driving element with respect to said end of the wrench head and thereby rotate the driving ratchet member.

2. The invention as defined in claim 1 wherein the guide means comprises a slide connection between the first and second handles.

3. The invention as defined in claim 1 wherein the resilient resistance member comprises an elongate coil spring having one end connected to the first handle and the other end connected to said one end of the drive element.

4. The invention as defined in claim 1 wherein the ratchet driving member is a sprocket and the elongate drive element is a chain looped around sprocket teeth of the sprocket.

5. The invention as defined in claim 1 wherein the driven ratchet member is provided with a male drive projection for insertion in a wrench socket.

6. The invention as defined in claim 1 wherein said end of the wrench head has an engagement surface for the second handle which is inclined with respect to the first handle in a direction toward the opposite end of the wrench head.

7. The invention as defined in claim 6 wherein said other end of the drive element is attached to a V-shaped projection on the second handle engageable in a corresponding recess in said surface.

8. A ratchet wrench comprising a wrench head, a ratchet mechanism in the wrench head for rotating a wrench drive member, an elongate handle extending from one end of the ratchet head, an elongate spring in said handle, a chain extending from said spring around the ratchet mechanism and emerging from said end of the handle, a second handle connected to the other end of said chain, a slide connection between the second handle and the first handle for providing reciprocatory movement of the second handle along the first handle effective to move the chain and operate the ratchet mechanism, and an extension extending laterally from the second handle for pivoting the second handle when the slide connection engages against said end of the wrench head and is also for moving the chain back and forth in the manner effective to operate the ratchet mechanism.

9. The invention as defined in claim 8 wherein the second handle includes a bridgepiece connected to the chain.

10. The invention as defined in claim 9 wherein the bridgepiece and said end of the wrench head have interengaging locating formations.

* * * * *